US006323745B1

(12) United States Patent
Toncich

(10) Patent No.: US 6,323,745 B1
(45) Date of Patent: Nov. 27, 2001

(54) PLANAR BANDPASS FILTER

(75) Inventor: Stanley S. Toncich, San Diego, CA (US)

(73) Assignee: Qualcomm Inc., San Diego, CA (US)

( * ) Notice: Subject to any disclaimer, the term of this patent is extended or adjusted under 35 U.S.C. 154(b) by 0 days.

(21) Appl. No.: 09/407,714

(22) Filed: Sep. 28, 1999

Related U.S. Application Data

(60) Provisional application No. 60/153,155, filed on Sep. 9, 1999.

(51) Int. Cl.[7] ..... H01P 1/205; H01P 1/203

(52) U.S. Cl. ..... 333/204; 333/219; 333/203; 333/246

(58) Field of Search ..... 333/204, 203, 333/219, 246, 238, 205

(56) References Cited

U.S. PATENT DOCUMENTS 4,551,696 * 11/1985 Moutrie et al. ..... 333/204
5,344,695 * 9/1994 Hirai et al. ..... 333/205 X
5,521,564 * 5/1996 Kaneko et al. ..... 333/175
5,986,525 * 11/1999 Sasaki et al. ..... 333/203

* cited by examiner

*Primary Examiner*—Robert Pascal
*Assistant Examiner*—Stephen E. Jones
(74) *Attorney, Agent, or Firm*—Philip R. Wadsworth; Gregory D. Ogrod

(57) ABSTRACT

A planar bandpass filter that comprises a substrate having a ground plane on one side and a plurality of resonators on the other side. Each resonator includes an elongated inductive portion and a capacitive portion. The elongated inductive portions are coupled through the substrate at the end opposite of the capacitive portion to the ground plane. The planar bandpass filter also includes a first tap and a second tap. The first tap is connected to a first elongated portion to serve as an input to the bandpass filter. The second tap is connected to a last elongated portion to serve as an output to the bandpass filter.

19 Claims, 6 Drawing Sheets

PLANAR BANDPASS FILTER

This application claims the benefit of provisional application No. 60/153,155, filed Sep. 9, 1999.

BACKGROUND OF THE INVENTION

I. Field of the Invention

The present invention relates generally to bandpass filters. In particular, the present invention is a planar bandpass filter.

II. Related Art

Filters are essential to the operation of most electronic circuits. Filters are implemented in electronic circuits to alter the amplitude and/or phase characteristics of a signal with respect to frequency. The design of bandpass filters for RF receivers/transceivers requires numerous tradeoffs with respect to circuit topology, bandwidth, clement realization, insertion loss, rejection level, etc. to arrive at a bandpass filter that satisfies all requirements. RF receivers/transceivers require bandpass filters that provide minimum insertion loss over the desired frequency band. In many cases, the design of conventional filters is driven by the range of capacitor values over the frequency band of interest.

Existing ceramic filters do not provide the rejection levels required by many RF applications without cascading the ceramic filters with other types of filters. Cascading filters results in increased insertion loss levels, and higher costs.

What is desired is a bandpass filter that does not require cascading ceramic filters to obtain the rejection level specifications needed. What is also needed is a bandpass filter that provides a repeatable design that does not require sampling and testing of multiple lumped element passive components such as capacitors or other filters, or tuning of the capacitors to achieve the desired performance levels of the filter. What is needed is a planar bandpass filter topology that provides a broadband response that eliminates reentrance frequencies at the desired rejection bands, while meeting the other requirements above.

One type of filter that satisfies some of these requirements is the combline filter. It can be realized in a planar form, is compact in size, and can be designed to provide a desired broad-band rejection characteristic.

Combline filters, however, have other problems associated with them. These problems arise when the production of mass quantities of filters is required, one of which is the use of lumped element capacitors in a conventional realization of the filter. Each filter usually includes a plurality of lumped element capacitors. Capacitor values vary over lot size. Variations in capacitor values can result in varied filter performance. To remedy the variation in capacitor values, a large quantity of capacitors could be tested to select capacitors with values that fall within a certain tolerance. Another alternative would be to build more filters than are needed, test each filter, and discard those filters that do not meet specifications. These remedies are very time consuming as well as expensive. Slight variations in the placement of the capacitors from filter to filter can also affect filter performance. Slight variations in filter topology from filter to filter, such as variations in tap points for tapped input and output resonators, can cause broadband response reentrance frequencies to occur at undesired harmonics of the passband.

SUMMARY OF THE INVENTION

The present invention satisfies the above mentioned needs by providing a planar bandpass filter having a repeatable or reproducible design that eliminates the need for lumped capacitor elements as well as the need for tuning the capacitors. The present invention is a planar bandpass filter that comprises a substrate having a ground plane on one side and a plurality of resonators on the other side. Each resonator includes an elongated inductive portion and a capacitive portion. The elongated inductive portions are coupled through the substrate at the end opposite the capacitive portion to the ground plane. The planar bandpass filter also includes a first tap and a second tap. The first tap is connected to a first elongated portion to serve as an input to the bandpass filter. The second tap is connected to a last elongated portion to serve as an output to the bandpass filter.

The present invention eliminates the need for lumped element capacitors by implementing loading capacitors using transmission lines. Thus, the loading capacitors of the present invention do not require tuning. Loading capacitors result in the reduction of the length of the associated resonators to approximately 45 degrees in electrical length. Resonator lengths of 45 degrees result in a compact structure with excellent stopband performance. Another advantage of this topology is that the filter's reentrance frequencies occur at much higher frequencies, and multiples of the reentrance frequencies are spaced farther apart. The present topology places the reentrance frequencies at portions of the frequency band where the harmonics do not appear.

Further embodiments, features, and advantages of the present invention, as well as the structure and operation of the various embodiments of the present invention, are described in detail below with reference to the accompanying drawings.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the pertinent art to make and use the invention.

Figure 1B:
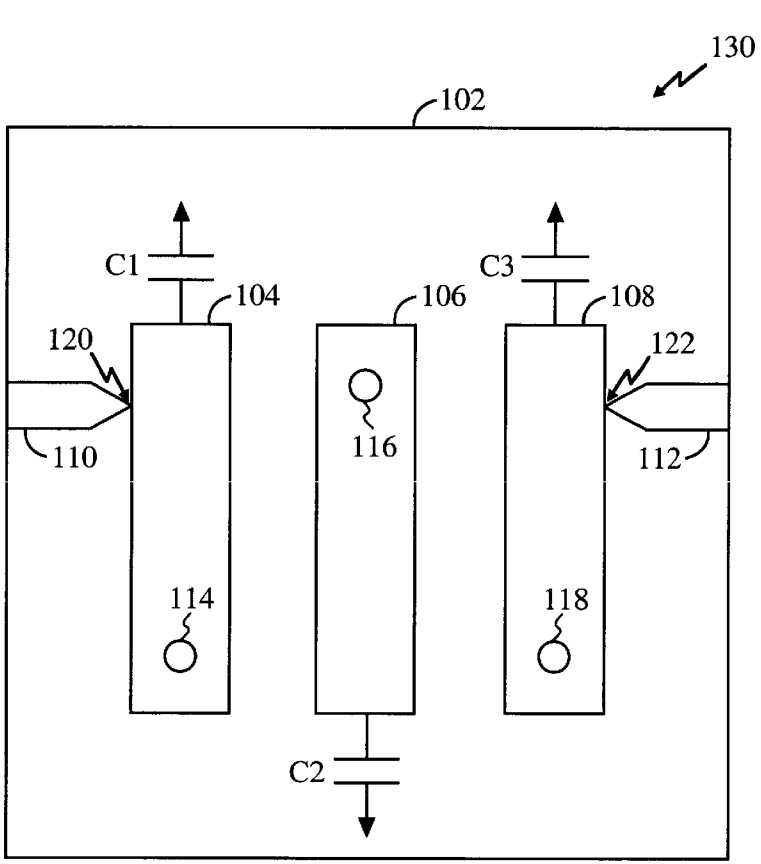
FIG. 1B Prior Art
FIGS. 1A and 1B are diagrams illustrating conventional third order combline bandpass filters.

The features, objects, and advantages of the present invention will become more apparent from the detailed description set forth below when taken in conjunction with the drawings in which like reference characters identify corresponding elements throughout. In the drawings, like reference numbers generally indicate identical, functionally similar, and/or structurally similar elements. The drawings in which an element first appears is indicated by the leftmost digit(s) in the corresponding reference number.

DETAILED DESCRIPTION OF THE PREFERRED EMBODIMENTS

While the present invention is described herein with reference to illustrative embodiments for particular applications, it should be understood that the invention is not limited thereto. Those skilled in the art with access to the teachings provided herein will recognize additional modifications, applications, and embodiments within the scope thereof and additional fields in which the present invention would be of significant utility.

Combline Filters

Figure 1A:
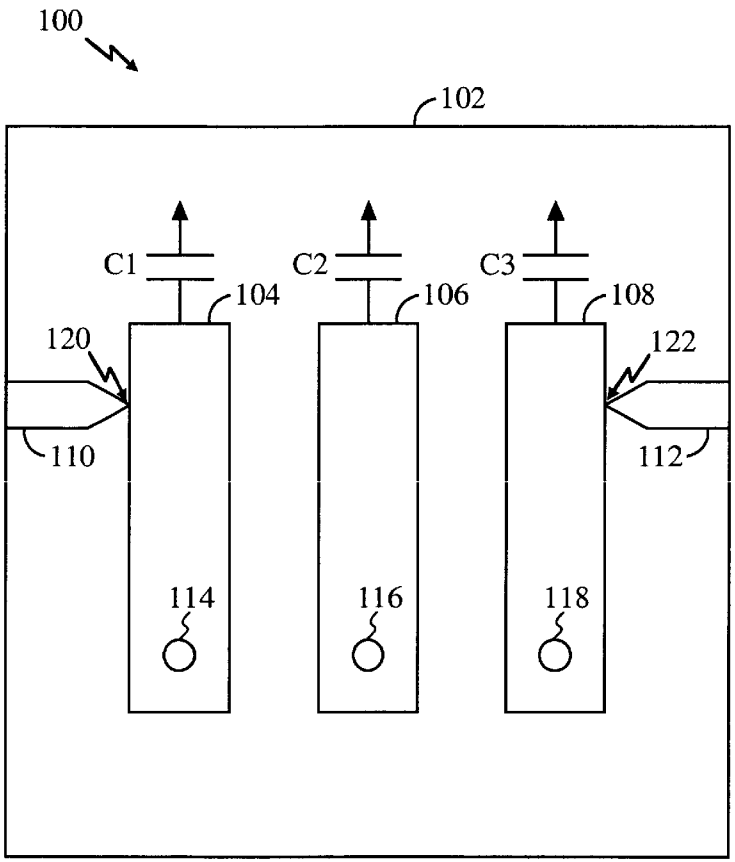
FIG. 1A Prior Art

Conventional third order combline bandpass filters 100 and 130 are shown in FIGS. 1A and 1B. Combline bandpass filter 100, shown in FIG. 1A, comprises apiece of substrate 102 having three mutually coupled resonators 104, 106, and 108 and a pair of taps 110 and 112. Each resonator 104, 106, and 108 is comprised of a microstrip line coupled to a lumped capacitor element C1, C2, and C3 on one end and a ground hole or via hole 114, 116, and 118 on the other end. Via holes 114, 116, and 118, or conductive vias, such as can be provided by metallic coated or filled passages in the substrate, connect resonators 104, 106, and 108 to a ground plane (not shown) on the opposite side of substrate 102. Tap 110 is coupled to resonator 104. Tap 112 is coupled to resonator 108. Taps 110 and 112 coupled to resonators 104 and 108 (located at each end of filter 100) are referred to as tapped input and output resonators because they are used for inputting and outputting signals to and from combline bandpass filter 100. The position of taps 110 and 112 relative to end resonators 104 and 108, respectively, are referred to as tap points (indicated as 120 and 122). The position of taps 110 and 112 is a dominant factor in determining the input/output impedance, respectively. Other factors that affect input and output impedances include the spacing between resonators and resonator line widths.

Combline bandpass filter 130, shown in FIG. 1B, is identical to combline bandpass filter 100 except that resonator 106 is positioned in the opposite direction of end resonators 104 and 108. That is, resonator 106 has the location of its loading capacitor C2 and ground (via hole 116) reversed.

Figure 2:
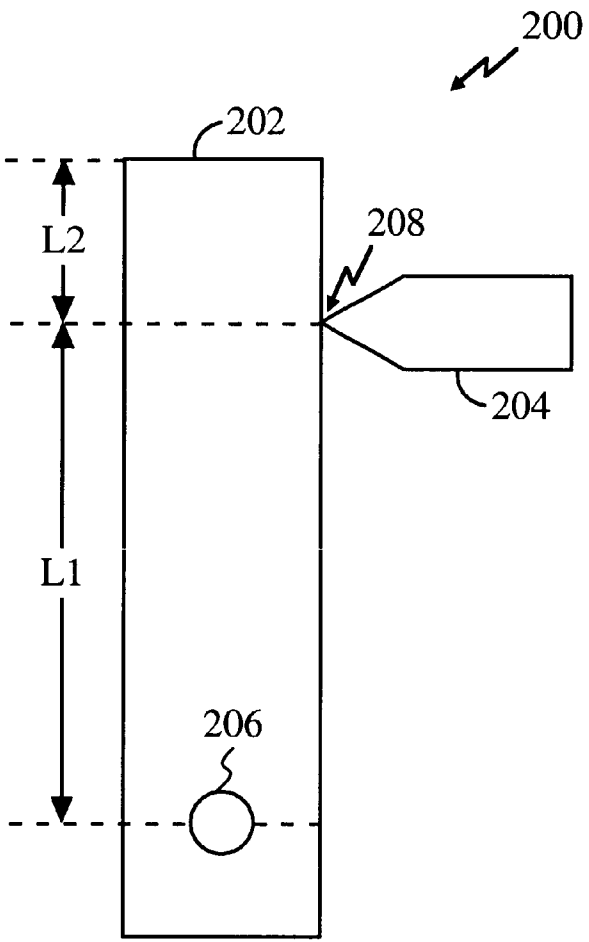
FIG. 2 is a diagram illustrating input and output impedance adjustments using a tapped resonator.

FIG. 2 represents an enlarged view of an end resonator 202, such as end resonators 104 and 108 in FIG. 1, coupled to a tap 204. End resonator 204 includes a via hole 206 at one end. A tap point 208 is indicated by the placement of tap 204 relative to end resonator 202. End resonator 202 is divided into two parts, L1 and L2. L1 indicates the physical distance from the grounded end (via hole 206) of end resonator 202 to the center of tap point 208. L2 indicates the physical distance from the center of tap point 208 to the top of end resonator 202. As previously stated, the position of tap 204 relative to end resonator 202 is the dominant factor in determining the input or output impedance. The input/output impedance is approximated by the ratio of L2 to L1, which can be represented by the relationship:

Impedance L2/L1.

Referring back to FIGS. 1A and 1B, to change the impedance level at the input or output of combline bandpass filters 100 or 130, taps 110 and 112, respectively, can be moved up or down to obtain the desired input or output impedance level. When designing for equal input and output impedances, tap points 120 and 122 will be at the same level on end resonators 104 and 108, respectively. Note that equal input and output impedance levels enable combline bandpass filters 100 and 130 to operate in either direction without having to specify an input side and an output side. When designing for unequal input and output impedances, tap points 120 and 122 will not be at the same level on resonators 102 and 106. Unequal input and output impedances require the specification of an input side and an output side.

A characteristic of microwave filters is that they exhibit reentrance modes. At a higher frequency, the overall structure of the filter is going to resonate again. The frequencies at which the overall structure of the filter resonates are called reentrance frequencies. Reentrance frequencies occur at some multiple of the geometric parameters of the filter, and are undesirable effects.

To obtain broadband rejection performance from bandpass filters 100 and 130, the length of L2 must be very small to drive the first reentrance frequency to a very high frequency. In fact, L2 must be on the order of a few thousandths of an inch.

Problems arise when combline bandpass filters 100 and 130 are produced in mass quantities. Capacitor values for C1, C2, and C3 will vary over lot sizes. Geometries of the microstrip lines will also vary from filter to filter. Tolerances needed to maintain the length of L2 to within a few thousandths of an inch for broadband rejection performance arc also difficult to achieve. These variations result in varied filter performance over a large sample size of filters. To remedy the varied capacitor values, a plurality of capacitors can be tested to select capacitors with values that fall within a certain tolerance. Another solution would be to build more combline bandpass filters 100 or 130 than are needed and discard the combline bandpass filters 100 or 130 that do not meet specifications. Again, these remedies are very time consuming and expensive.

Overview of the Present Invention

The present invention is a planar bandpass filter. The planar bandpass filter of the present invention provides low passband insertion loss while maintaining good broadband harmonic rejection. The present invention modifies the combline filter design by using printed elements or lengths of transmission line to form capacitors. Thus, the present invention eliminates the need for using any lumped capacitor element components. The present invention also eliminates the need to sample and test multiple capacitors to obtain capacitors that fall within a certain tolerance level.

The planar bandpass filter of the present invention was simulated using a computer software simulator package entitled SUPERSTAR manufactured by EAGLEWARE™, which is incorporated herein by reference in its entirety. The planar bandpass filter of the present invention was also simulated using a computer software simulator package entitled TOUCHSTONE™ manufactured by HP/EESOF, which is incorporated herein by reference in its entirety.

Prior to describing the planar bandpass filter of the present invention in detail, a simplified block diagram of a system in which a planar bandpass filter of the present invention can be implemented will be described.

System for Implementing the Present Invention

Figure 3:
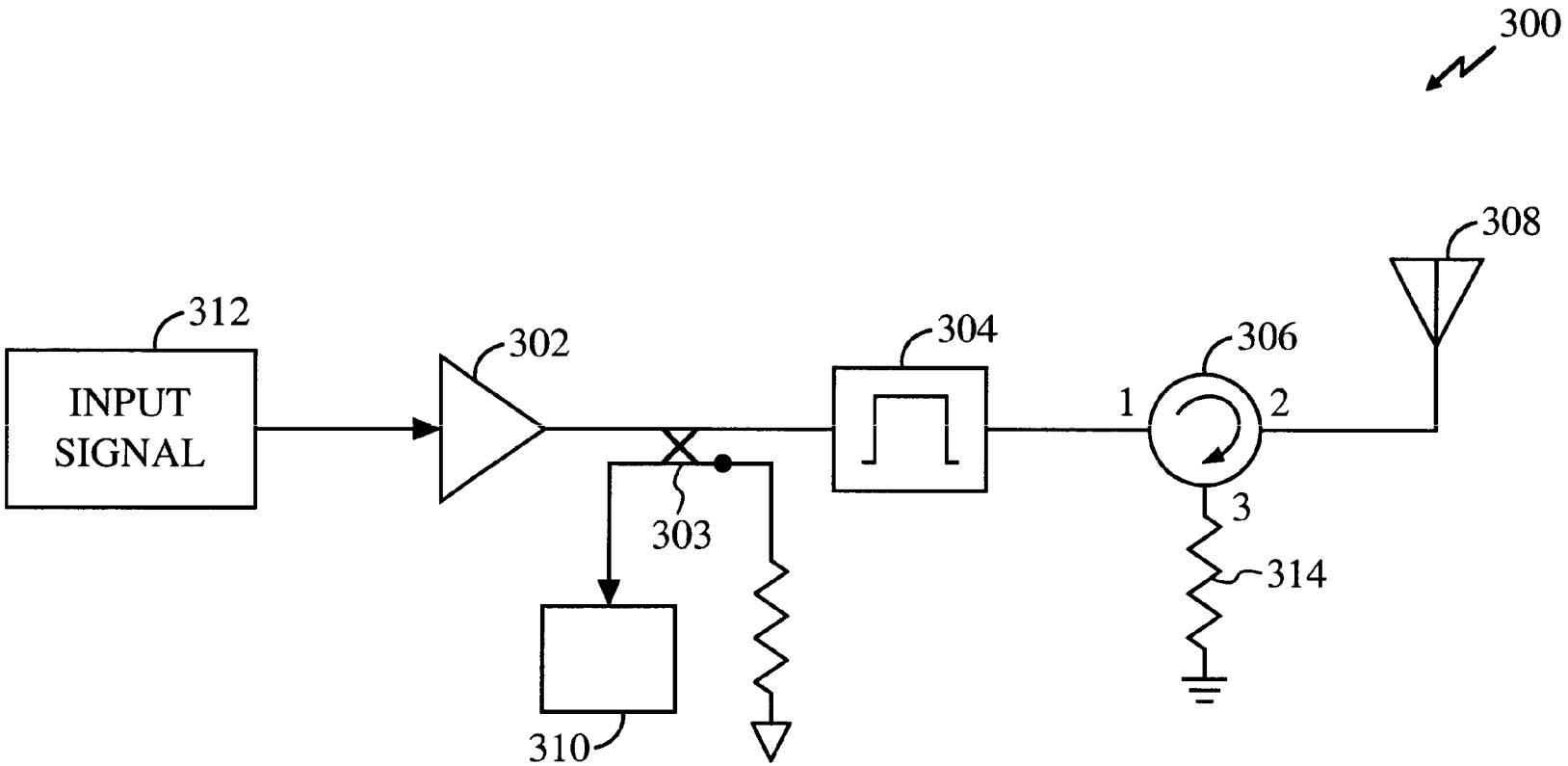
FIG. 3 is a block diagram illustrating an exemplary implementation of a planar bandpass filter according to an embodiment of the present invention.

FIG. 3 is a block diagram illustrating an exemplary system in which a planar bandpass filter according to an embodiment of the present invention is implemented. Exemplary system 300 comprises a power amplifier 302, a coupler 303, a planar bandpass filter 304, an isolator 306, an antenna 308, and a power detection circuit 310. Power amplifier 302 is connected to planar bandpass filter 304 via coupler 303. Power amplifier 302 is also coupled to power detection circuit 310 via coupler 303. Planar bandpass filter 304 is connected to an isolator 306. Isolator 306 is connected to antenna 308.

An input signal 312 enters power amplifier 302, where it is amplified. Coupler 303 is used to direct a portion of the amplified signal to power detection circuit 310 and a portion of the amplified signal to planar bandpass filter 304. Coupler 303 may be a 30 dB or 40 dB coupler. A small portion of the amplified input signal is coupled into power detection circuit 310 via coupler 303. Power detection circuit 310 is used to detect the power level of the amplified input signal. The remaining (larger) portion of amplified input signal is applied to planar bandpass filter 304, where it is filtered. The planar bandpass filter 304 provides an insertion loss level of less than or equal to 0.6 dB over the 1610–1626.5 MHz passband. It also provides greater than 40 dB rejection from 2483–2500 Mhz, and greater than 15 dB broadband out to 12 GHz, at the harmonics of the transmission frequencies for a typical Low Earth Orbit (LEO) satellite communications system.

The present invention is described using a planar bandpass filter that provides a low passband insertion loss of 0.6 dB from 1610–1626.5 MHZ, greater than 40 dB rejection from 2483–2500 MHz, and greater than 15 dB broadband rejection out to approximately 12 GHz, again at the harmonics for an exemplary satellite communications system. However, the present invention is not limited to a planar bandpass filter providing such specifications. The resonator lengths of this realization of a planar combline bandpass filter can also be adjusted to optimize harmonic rejection, if desired. This was, in fact done for use in the LEO system in question. One skilled in the relevant art(s) would know that other planar bandpass filters having different topology geometries will provide planar bandpass filters of a similar kind with different specifications without departing from the scope and spirit of the present invention.

Isolator 306 is used to prevent potential interference of signals being picked up by antenna 308 and fed back into exemplary system 300. Isolator 306 is comprised of three ports: port 1, port 2, and port 3. Port 1 of isolator 306 connects to the output of planar bandpass filter 304. Port 2 of isolator 306 connects to antenna 308. Port 3 of isolator 306 is connected to a load 314. Load 314 is also connected to ground on the side opposite of port 3 of isolator 306. Signals entering port 1 of isolator 306 exit at port 2. Signals entering port 2 of isolator 306 are fed into load 314 via port 3. Signals being fed back into antenna 308 are fed into load 314, and thus, are prevented from being fed back into system 300. Antenna 308 is used for transmitting the filtered signal.

The Planar Bandpass Filter

Figure 4:
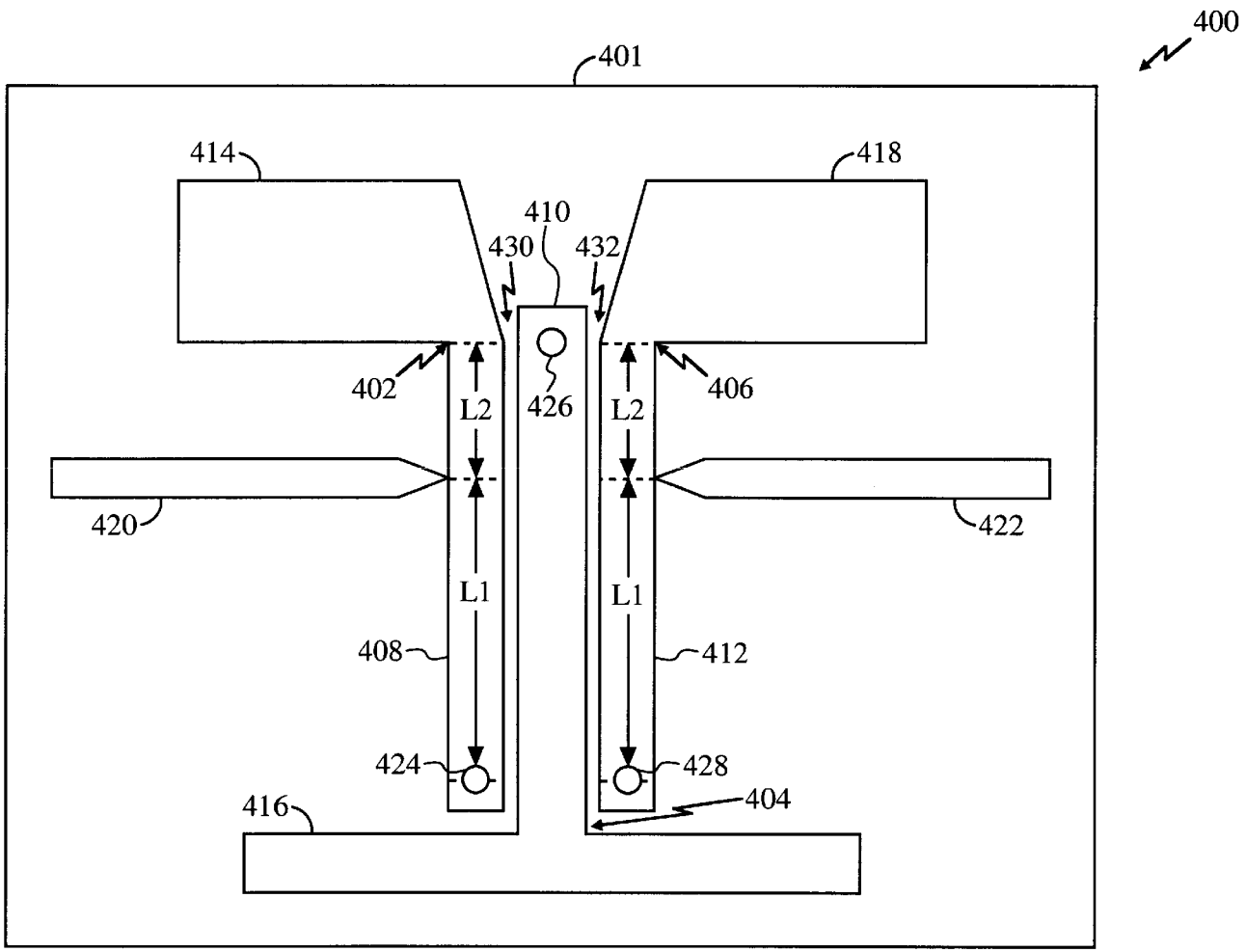
FIG. 4 is a diagram illustrating a top view of a third order planar bandpass filter according to an embodiment of the present invention.

FIG. 4 is a diagram illustrating a top view of a third order planar bandpass filter according to an embodiment of the present invention. FIG. 4 represents a planar bandpass filter 400 that is illustrated at a scale of approximately four times the size of the actual filter. Planar bandpass filter 400 comprises a piece of substrate 401 having three mutually coupled resonators 402, 404, and 406 and a pair of taps 420 and 422. Each resonator 402, 404, and 406 is comprised of an inductor 408, 410, and 412 coupled to a loading capacitor 414, 416, and 418 on one end and a via hole (shown as circles 424, 426, and 428) on the other end. Each resonator 402, 404, and 406 is comprised of metal, such as copper or silver. Via holes 424, 426, and 428 connect resonators 402, 404, and 406 to a ground plane (not shown) on the opposite side of substrate 401.

As previously stated, loading capacitors 414, 416, and 418 result in the reduction of the length of resonators 402, 404, and 406. Resonator length for the planar bandpass filter of the present invention is a design choice that ranges from approximately 45 degrees to less than 90 degrees in electrical length. Resonator electrical lengths of 90 degrees cannot be used because a 90 degrees length totally cancels the desired magnetic and electrostatic coupling. Resonator electrical lengths of approximately 45 degrees result in a compact structure that provides excellent stopband performance. Resonator electrical lengths can be reduced below 45 degrees, but at the expense of using larger capacitive values, thereby causing increased insertion loss. The electrical length of resonators 402, 404, and 406 are approximately 45 degrees.

Tap 420 is coupled to resonator 402. Tap 422 is coupled to resonator 406. Taps 420 and 422 coupled to resonators 402 and 406 (located at each end of the filter) are referred to as tapped input and output resonators because they are used for inputting and outputting signals to and from filter 400. The position of taps 420 and 422 relative to resonators 402 and 406, respectively, are referred to as tap points. The position of taps 420 and 422 is a dominant factor in determining the input/output impedance for planar bandpass filter 400. Other factors that affect input and output impedances include the spacing between resonators (also referred to as gap spacing) and resonator line widths. The design of planar bandpass filter 400 provides for an input and output impedance of 50 ohms. Because the input and output impedances are the same, the tap positions for taps 420 and 422 are substantially the same as well. Equal input and output impedances make planar bandpass filter 400 symmetrical. Either tap, 420 or 422, can be used as input or output. The design of planar bandpass filter 400 can be modified to allow for different values of input and output impedance by placing taps 420 and 422 at different positions, thereby modifying the ratios of L2/L1 for resonator 402 and 406. A positive change in L1 or L2 causes the frequency response of filter 400 to shift downward in frequency. Alternatively, a negative change in L1 or L2 causes the frequency response of filter 400 to shift upward in frequency. This is most noticeable in the 2483 to 2500 MHz rejection band.

Inductance and Capacitance of the Planar Bandpass Filter

In a conventional quarter wave transmission line resonator, the inductance and capacitance associated with the resonator are continuously distributed along its length. Near the grounded end where the voltage is correspondingly low, the inductive effects dominate the capacitive effects. At the open circuited end, where the current is small and the voltage is large, capacitive effects dominate the inductive effects. The inductive effects can be enhanced by using a narrower resonator width, while conversely, the capacitive effects may be enhanced by using wider resonator widths. If both effects are used simultaneously, a narrower line width near the shorted end coupled with a wider line width near the open end, both the capacitance and inductance are increased. This has the effect of decreasing the resonant frequency of the resonator while increasing the frequency of the first appearance of a reentrance mode.

Inductors 408,410, and 412 are comprised of printed elements represented by narrow widths of transmission lines. An increase in the inductor width causes positive shifts in frequency in the 2483–2500 MHz rejection band. Alternatively, a decrease in inductor width causes negative shifts.

Larger valued capacitors result in shorter resonator length and higher frequency reentrant modes, at the expense of lower capacitor Q and higher passband insertion loss. Smaller capacitor values work better with regard to passband insertion loss. The geometry of printed capacitors 414, 416, and 418 was chosen to provide small loading capacitor values of 1.0 pF (Pico Farads). The layout of loading capacitors 414, 416, and 418 was based on the spacing between resonators 402, 404, and 406.

A change in length of loading capacitors 414 and 418 results in a change in the 2483–2500 MHz rejection band. For longer capacitive lengths, the 2483–2500 MHz rejection band moves downward in frequency. Alternatively, for shorter capacitive lengths, the 2483–2500 MHz rejection band moves upward in frequency.

Larger valued capacitors result in shorter resonator length and higher frequency reentrant modes, at the expense of lower capacitor Q and higher passband insertion loss. Smaller capacitor values work better with regard to passband insertion loss. The geometry of printed capacitors 414–418 was chosen to provide small loading capacitor values of 1.0 pF (Pico Farads). The layout of loading capacitors 414–418 was based on the spacing between resonators 402–406.

The present invention provides trade-off flexibility between line length and width for determining the optimum distributed capacitance to replace lumped element capacitors C1–C3, shown in combline filters 100 and 130. To allow for more space between printed loading capacitors 414, 416, and 418, and to reduce the effect of undesired coupling between closely spaced lines, middle resonator 404 has its loading capacitor 416 inverted. That is, rather than placing all loading capacitors 414, 416, and 418 on one side of the circuit with the opposite side of the resonators all at ground, middle resonator 404 has the location of its loading capacitor 416 and ground (via hole 426) reversed. This arrangement allows for the physical placement of printed capacitor elements 414, 416, and 418 at the ends of their respective resonators 402, 404, and 406.

To reduce the area encompassed by filter 400, printed loading capacitors 414 and 418 were bent so as to be parallel to the input/output lines of planar bandpass filter 400. Middle resonator 404 has its printed loading capacitor 416 split into a "T" configuration, allowing for two narrow lines to run alongside the lower edge of planar bandpass filter 400. The effect of the two narrow lines connected in the "T" configuration is that of two microstrip lines in parallel at the junction where they meet resonator 404. An increase in the length of the microstrip line of the inverted "T" portion of filter 400 causes the frequency response of filter 400 to shift slightly upward in frequency. Alternatively, a decrease in the length of the microstrip line of the inverted "T" portion of filter 400 causes the frequency response of filter 400 to shift slightly downward in frequency. An increase in the width of the microstrip line of the inverted "T" portion of filter 400 causes the frequency response of filter 400 to shift slightly downward in frequency. Alternatively, a decrease in the width of the microstrip line of the inverted "T" portion of filter 400 causes the frequency response of filter 400 to shift slightly upward in frequency.

Although middle printed loading capacitor 416 in resonator 404 is split into a "T" configuration, this was done because of size constraints. Other configurations for printed loading capacitor 416, such as a rectangular configuration, could be used without departing from the scope and spirit of the present invention.

Capacitors 414 and 418 are beveled at the inner edges to minimize the transition from inductors 408 and 412 to capacitors 414 and 418. In an alternative embodiment, capacitors 414 and 418 could be rectangular in shape.

Resonator 404 contains an additional length L' to allow the "T" section of resonator 404 to sufficiently clear the grounded ends of tapped input/output resonators 402 and 406. This additional length, L', causes minimal impact on filter performance. L', for planar bandpass filter 400, is typically chosen to be 0.045 inches in length at the exemplary frequencies of interest discussed above. This length can be transferred to any other design without concern of an impact on performance.

Gap Spacing in the Planar Bandpass Filter

Planar bandpass filter 400 also comprises gap spacing 430 and 432. Gap spacing 430 and 432 represent the spacing between resonators 402, 404, and 406. For planar bandpass filter 400, gap spacing 430 is substantially the same as or identical to gap spacing 432. Gap spacing 430 and 432 can be adjusted to provide different desired coupling and filter responses. Changes in gap spacing result in changes to the passband of filter 400. An increase in gap spacing results in a narrower bandwidth. A decrease in gap spacing results in a wider bandwidth.

Dimensions of Planar Bandpass Filter Based on the Dielectric Constant

Figure 5:
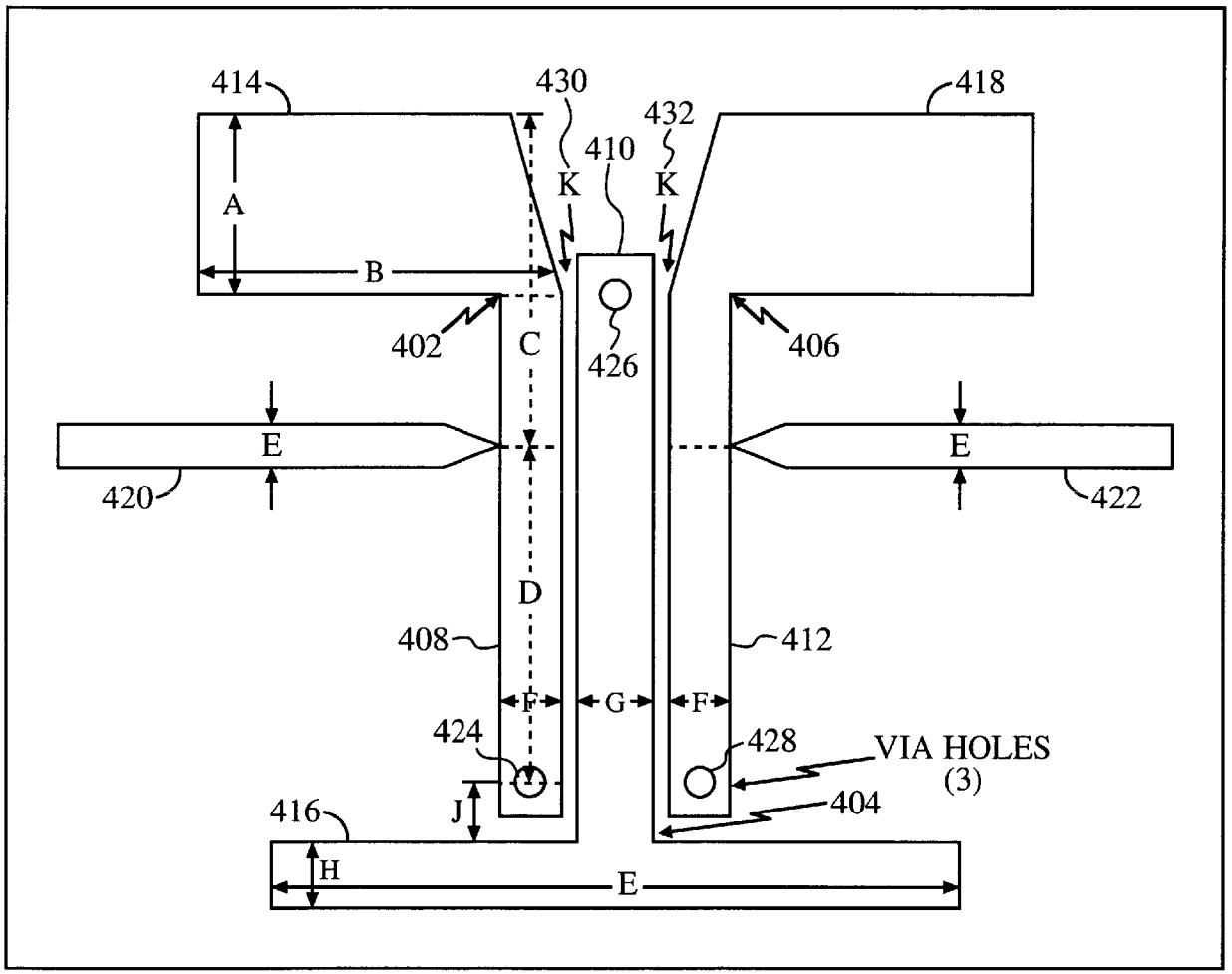
FIG. 5 is a diagram illustrating a general topology of a planar bandpass filter according to an embodiment of the present invention.

A general topology of planar bandpass filter 400 is shown in FIG. 5. FIG. 5 represents a planar bandpass filter 400 shown at a scale that is about seven times the size of the actual filter. Letters 'a' through 'k' are shown to represent the dimensions of planar bandpass filter 400. The dimensions of planar bandpass filter 400 will vary depending on the dielectric constant of substrate 401. The dielectric constant can vary from that of air (~1.0) on up to ~100. For practical designs, however, a maximum dielectric constant of ~20 should be used for substrate 401.

Table 1 lists the actual geometric dimensions, represented by letters 'a' through 'k' in FIG. 5, for two dielectric constants. A dielectric constant of 9.6 (shown in column 2 of Table 1) is representative of the generic substrate alumina ($Al_2O_3$). The substrate thickness for $Al_2O_3$ is 25 mils. A dielectric constant of 3.38 (shown in column 3 of Table 1) is representative of the substrate R04003, manufactured by Rogers Corporation. The substrate thickness for R04003 is also 25 mils. The length of taps 420 and 422 are arbitrary. The overall box in which filter 400 is enclosed, is for the artwork generation and is of no consequence to the filter's operation.

TABLE 1

| Geometry | $Al_2O_3$ Dielectric Constant = 9.6 (25 mil. thickness) Dimensions (inches) | R04003 Dielectric Constant = 3.38 (25 mil. thickness) Dimensions (inches) |
|---|---|---|
| a | 0.115 | 0.140 |
| b | 0.185 | 0.248 |
| c | 0.0935 | 0.2325 |
| d | 0.2075 | 0.4265 |
| e | 0.024 | 0.072 |
| f | 0.036 | 0.040 |
| g | 0.036 | 0.040 |
| h | 0.040 | 0.040 |
| i | 0.400 | 0.550 |
| j | 0.040 | 0.045 |
| k | 0.011 | 0.013 |

Referring to FIG. 5, note that for different topologies, width 'g' of middle resonator 404 can be different from width 'f' of end resonators 402 and 406. Also, gap spacing 430 and 432 (shown as 'k' in FIG. 5) does not have to be the same width as well. Planar bandpass filter 400 is not limited to the exemplary substrate materials and substrate thicknesses listed in Table 1. Other substrate materials and substrate thicknesses could be used, without departing from the scope and spirit of the present invention.

The primary effect of dielectric constant variations is to shift the frequency response of the filter up or down, as the dielectric constant changes down or up, respectively. The effect of dielectric constant variations on filter 400's passband is insignificant. Vendor specified variations in dielectric constant do not cause planar bandpass filter 400 to exceed specification limits. Also, the effect of variations in the dielectric constant on harmonics is insignificant.

Filter Response

Figure 6:
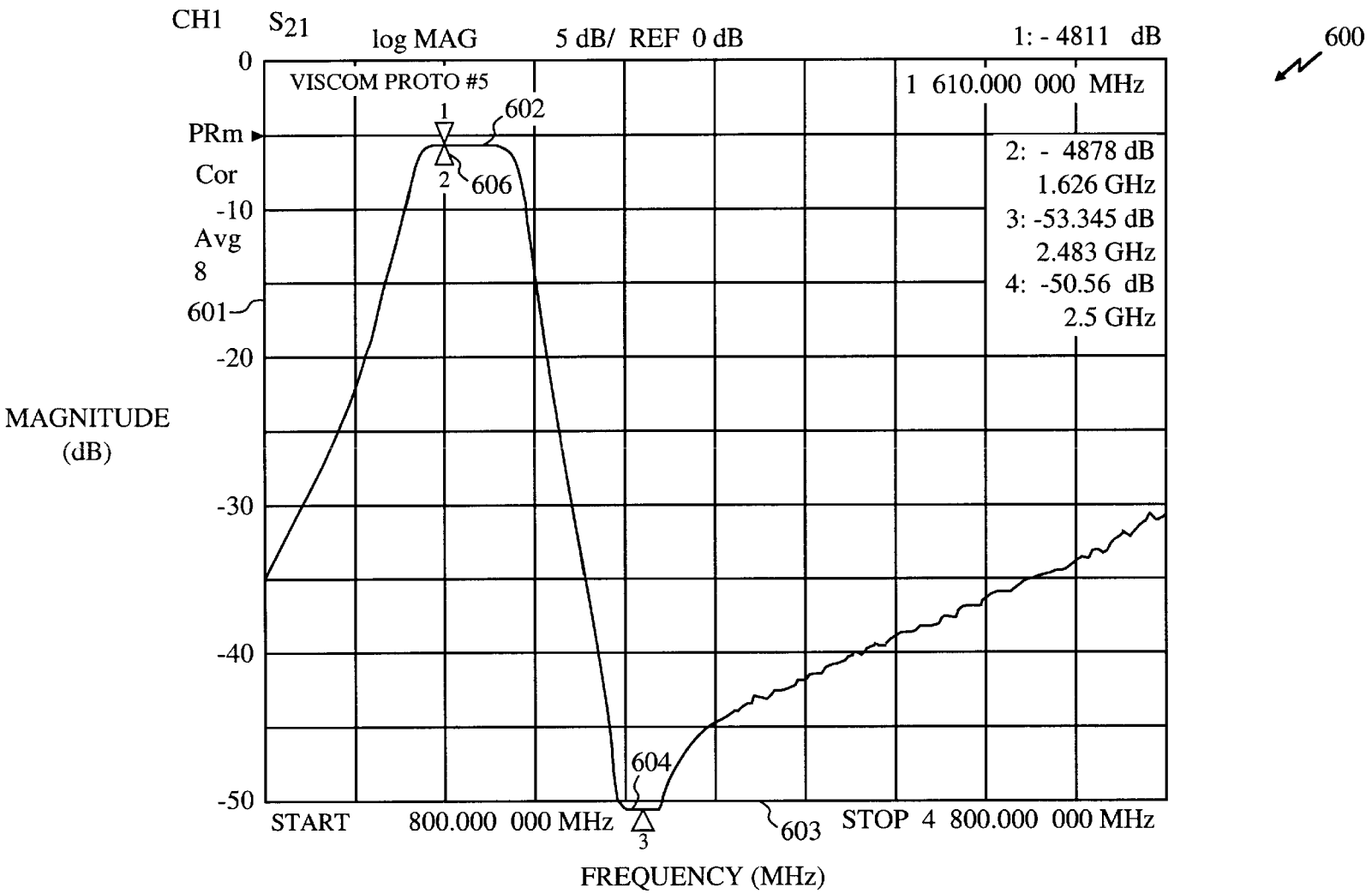
FIG. 6 is a diagram illustrating a measured frequency response for a planar bandpass filter according to an embodiment of the present invention.

FIG. 6 is a diagram illustrating a measured frequency response for an exemplary planar bandpass filter 400 using $Al_2O_3$ material for the substrate. Frequency response 600 is comprised of a y-axis 601, an x-axis 603, and a filter frequency response 602. The y-axis 601 represents the magnitude of the frequency response in dBs. The x-axis 603 represents the frequency in MHz. Filter frequency response 602 includes an insertion loss of 0.4878 dB from 1610–1626.5 MHz (606) and a 53.345 rejection level from 2483–2500 MHz (604). Filter frequency response 602 also provides greater than 15 dB rejection out to 12 GHz (not shown), at the harmonics of an exemplary satellite system transmission frequency. As shown in FIG. 6, filter 400 exceeds the desired specifications of an insertion loss level of less than 0.6 dB over the 1610–1626.5 MHz passband, greater than 40 dB rejection from 2483–2500 MHz, and greater than 15 dB rejection out to 12 GHz.

Alternative Topologies

The present topology of planar bandpass filter 400 utilizes three resonators 402, 404, and 406. In an alternative embodiment, the topology of planar bandpass filter 400 can be extended to include more resonators. In yet another alternative embodiment, the topology of planar bandpass filter 400 could be lessened to include only two resonators.

Conclusion

By altering the geometry of planar bandpass filter 400, the effect of the filter response can be controlled. The specific length and width of each section of bandpass filter 400 was chosen to optimize both a narrow band and a broadband response. The narrow band response is the passband response of 1610–1626.5 MHz and the greater than 40 dB rejection at 2483–2500 MHz. The broadband response is the greater than 15 dB rejection out to 12 GHz, at the harmonics of an exemplary satellite system transmission frequency. One skilled in the relevant art(s) would know that other geometries could be used to tailor planar bandpass filter 400 to specific application needs without departing from the scope and spirit of the present invention. The resonator lengths of this realization of a planar combline bandpass filter can also be adjusted to optimize harmonic rejection, if desired. This was, in fact done for constructing filters for use in an exemplary LEO system.

The previous description of the preferred embodiments is provided to enable any person skilled in the art to make or use the present invention. While the invention has been particularly shown and described with reference to preferred embodiments thereof, it will be understood by those skilled in the art that various changes in form and detail may be made therein without departing from the spirit and scope of the invention. Thus, the breadth and scope of the present invention should not be limited by any of the above-described embodiments, but should be defined only in accordance with the following claims and their equivalents.

What I claim as my invention is:

1. A bandpass filter, comprising:

a substrate, having a ground plane on one side;

a plurality of resonator elements, each having an elongated inductive portion and a capacitive portion, said inductive portions being substantially parallel to each other, wherein each of said inductive portions electrically connects to said ground plane at the end opposite to said capacitive portion, said plurality of resonator elements having a first resonator element, a middle resonator element, and a last resonator element, wherein said middle resonator element is placed opposite to said first and last resonator elements;

a first tap electrically connected to a first elongated inductive portion to serve as an input to said filter; and a second tap electrically connected to a last elongated inductive portion to serve as an output to said filter;

wherein each of said capacitive portions is comprised of printed elements represented by transmission lines, wherein said transmission line for said capacitive portions of said first and last resonator elements is comprised of a wide width transmission line and said transmission line for said middle resonator is comprised of a "T" shaped transmission line with the upper portion of the "T" shape comprising said capacitive portion, wherein said middle resonator element is longer in length than said first and last resonator elements by an amount L and wherein said capacitive portions of said first and last elongated inductive portion are bent, so as to be parallel to said first and second taps, and beveled at the inner edges to minimize the transition from inductance to capacitance.

2. The bandpass filter of claim 1, further comprising first and second tap points, wherein said first tap point is the position of said first tap to said first elongated inductive portion and said second tap point is the position of said second tap to said last elongated inductive portion, wherein said first and second tap points aid in determining the input and output impedances.

3. The bandpass filter of claim 2, wherein said bandpass is symmetrical if said first and second tap points are equal.

4. The bandpass filter of claim 1, wherein said inductive portion of said plurality of resonator elements is comprised of printed elements represented by narrow widths of transmission lines.

5. The bandpass filter of claim 1, wherein said capacitive portion of said plurality of resonator elements is comprised of a wide width of transmission line, wherein said wide width of transmission line for said upper portion of said "T" configuration is split to form said "T" configuration.

6. The bandpass filter of claim 1, wherein said capacitive portion of said plurality of resonators are loading capacitors that result in a reduction in the length of said plurality of resonators.

7. The bandpass filter of claim 1, wherein said capacitive portions of said plurality of resonators are comprised of printed elements of wide width transmission lines and said inductive portions of said plurality of resonators are comprised of printed elements of narrow width transmission lines to effect a reentrance mode for said bandpass filter at a higher frequency.

8. The bandpass filter of claim 1, wherein said bandpass filter provides low insertion loss.

9. The bandpass filter of claim 1, wherein said bandpass filter provides broadband harmonic rejection.

10. The bandpass filter of claim 1, wherein the location of said first and second taps are chosen to give the desired input and output impedances.

11. A planar bandpass filter, comprising:

a substrate having a plurality of resonators and first and second taps on one side, and a ground plane on the other side;

wherein each of said plurality of resonators comprises an inductive element coupled to a loading capacitor on one end, and having a via hole on the other end, wherein said via hole connects said each of said plurality of resonators to said ground plane; and wherein said first and second taps are coupled to a first and last resonator of said plurality of resonators to form tapped input and output resonators for receiving and sending signals to and from said planar bandpass filter, respectively, and wherein each of said loading capacitors is comprised of printed elements represented by transmission lines, wherein said loading capacitors are comprised of printed elements represented by wide widths of transmission lines and said capacitive portion of a middle resonator is split into a "T" configuration comprising two narrow width transmission lines, said middle resonator being longer than said first and last resonators by an amount L.

12. The planar bandpass filter of claim 11, wherein said first and second taps are coupled to said first and last resonators at first and second tap points, wherein the ratio of a second length, L2, to a first length, L1, is used to approximate an input and output impedance for said planar bandpass filter, wherein L2 is the length from said via hole of said tapped input/output resonators to said first/second tap points and L1 is the length from said first/second tap points to one end portion of said inductive clement of said tapped input/output resonators, respectively.

13. The planar bandpass filter of claim 12, wherein said planar bandpass filter is symmetrical if said first and second tap points are equal.

14. The planar bandpass filter of claim 11, wherein said loading capacitors of said first and last resonators are bent, so as to be parallel to said first and second taps, and beveled at the inner edges to minimize the transition from inductance to capacitance.

15. The planar bandpass filter of claim 11, wherein said inductive elements arc comprised of printed elements represented by transmission lines.

16. The planar bandpass filter of claim 11, wherein said loading capacitors are comprised of printed elements represented by wide width transmission lines and said inductive elements are comprised of printed elements represented by narrow width transmission lines to effect a reentrance mode for said planar bandpass filter at a higher frequency.

17. The planar bandpass filter of claim 11, wherein said plurality of resonators are mutually coupled.

18. The planar bandpass filter of claim 11, wherein said planar bandpass filter provides low insertion loss.

19. The planar bandpass filter of claim 11, wherein said planar bandpass filter provides broadband harmonic rejection.

* * * * *